US005573054A

United States Patent [19]

Swopes

[11] Patent Number: 5,573,054

[45] Date of Patent: Nov. 12, 1996

[54] VENETIAN BLIND SLAT

[75] Inventor: Cletis F. Swopes, Madison, Wis.

[73] Assignee: Springs Window Fashions Division, Inc., Middleton, Wis.

[21] Appl. No.: 371,991

[22] Filed: Jan. 12, 1995

[51] Int. Cl.[6] ..... E06B 9/00

[52] U.S. Cl. ..... 160/236; 160/178.4

[58] Field of Search ..... 160/236, 178.1 R, 160/178.1 V, 900

[56] References Cited

U.S. PATENT DOCUMENTS

| | | | |
|---|---|---|---|
| 3,676,537 | 7/1972 | Winstead . | |
| 3,790,436 | 2/1974 | Graham, Jr. et al. . | |
| 4,771,005 | 12/1987 | Chang . | |
| 4,818,590 | 4/1989 | Prince et al. . | |
| 5,121,785 | 6/1992 | Ohsumi . | |
| 5,423,367 | 6/1995 | Kataoka et al. | 160/236 X |

*Primary Examiner*—Blair Johnson
*Attorney, Agent, or Firm*—Vernon J. Pillote

[57] ABSTRACT

An elongate venetian blind slat having a longitudinally extending transversely convex upper surface and an opposed longitudinally extending transversely concave lower surface and opposed longitudinally extending edge surfaces. The slat comprises a rigid thermoplastic resin having a cellular core and an integral solid skin along the longitudinally surfaces of the slats and a density of 0.4 to 0.6 g/cc. The upper and lower surfaces of the slat have a radius of curvature less than the width of the slat and, preferably, the upper and lower surfaces have substantially the same radius of curvature.

6 Claims, 1 Drawing Sheet

FIG. 1
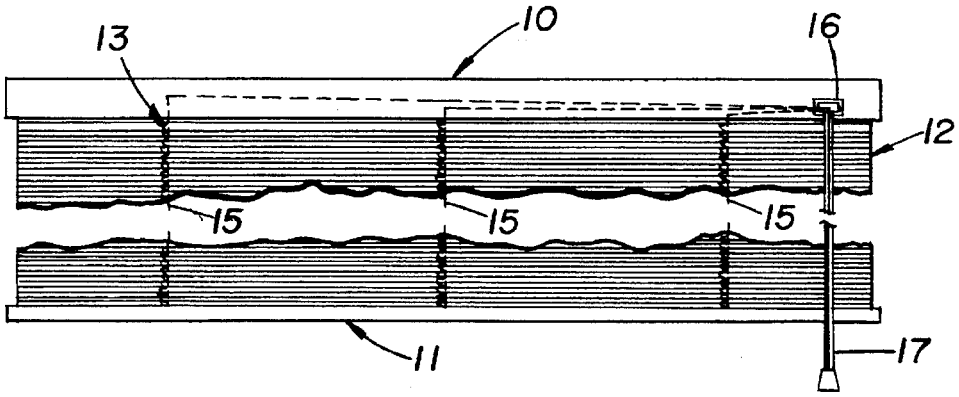
FIG. 2
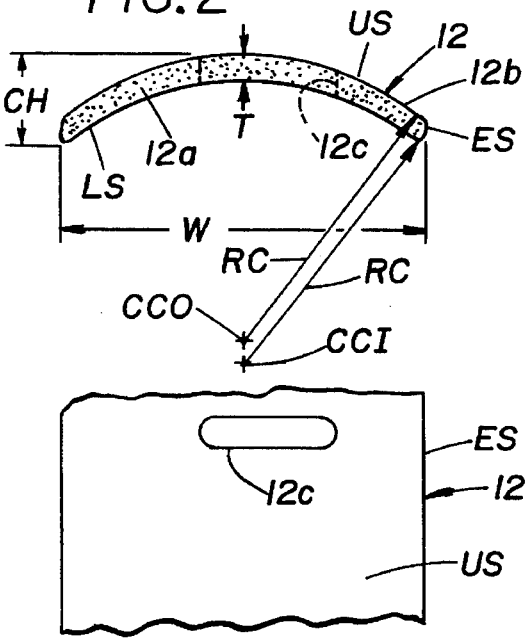
FIG. 4
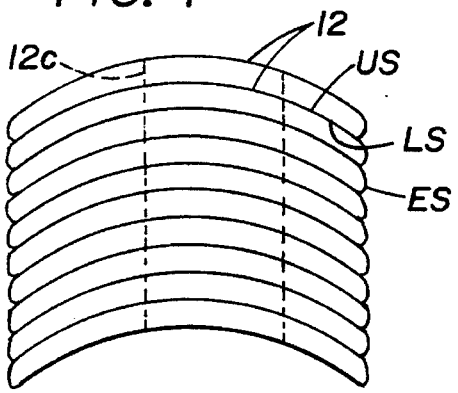
FIG. 5
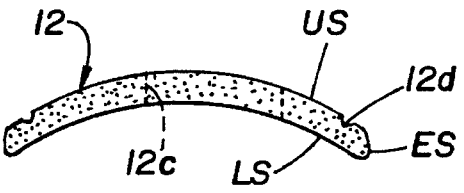
FIG. 6
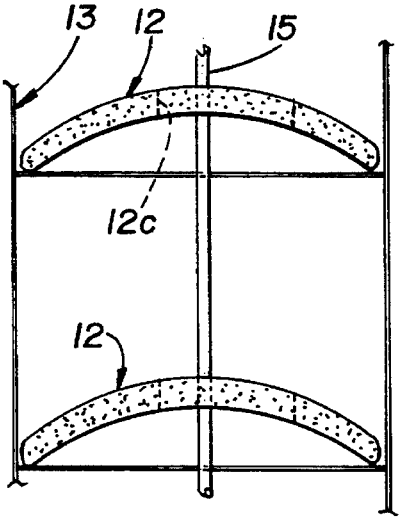
FIG. 3

VENETIAN BLIND SLAT

BACKGROUND OF THE INVENTION

Early venetian blinds were made with wide flat wood slats, but presented some problems because of warping, breakage and deterioration of the surface finish. Venetian blinds were later formed with slats of thin transversely arcuate sheet metal stock and, more recently, venetian blind slats have been formed of solid plastic material by thermo forming strip plastic sheet material or by extrusion.

U.S. Pat. No. 4,711,005 discloses thermo forming venetian blind slats from PVC strip material. As disclosed in that patent, thin PVC strip 2.5 cm in width and 0.05 to 0.06 cm in thickness is thermo formed to a shallowly curved 7.62 to 12.7 cm or greater radius in curvature. However, solid plastic materials such as rigid polyvinyl chloride commonly used in the formation of plastic venetian blind slats, have a density that is three or four times higher than the density of the woods used in wooden slats, and it was necessary to reduce the thickness of the solid plastic slats to control the lift weight of the blind, and to also reduce the spacing of the ladder tapes in order to prevent sagging or drooping of the plastic slats under the temperature and humidity conditions sometimes encountered in window areas.

U.S. Pat. No. 4,818,590 discloses forming wood veneer covered structural rigid plastic foam elements including venetian blind slats, having a rigid plastic foam substrate and a wood veneer adhered to opposite surfaces of the substrate. U.S. Pat. No. 5,121,785 discloses forming a venetian blind slat using a metal core plate with a wood veneer adhered to opposite faces of the metal core plate, and synthetic resin layers overlying the wood layers. In one alternative construction, a fiber reinforced plastic is substituted for the metal core plate, and in still another embodiment, the slat is formed with a wooden core plate with reinforcements of non-woven fabrics and resin sheets mounted to both faces of the core plate, and a pair of wooden plates mounted to the faces of the reinforcements. The formation and laminating of the slats from multiple individual layers as disclosed in these patents, necessarily increases the overall cost of making such venetian blind slats.

SUMMARY OF THE INVENTION

It is an object of the present invention to provide a venetian blind slat that can be economically produced, which is light in weight and has adequate strength to accommodate wide spacing of the ladder tapes that support the slats in a venetian blind, and which has a smooth continuous lengthwise extending outer surface.

Accordingly, the present invention provides an elongate venetian blind slat having a longitudinally extending transversely convex upper surface and an opposed longitudinally extending transversely concave lower surface and opposed longitudinally extending edge surfaces, the slat comprising a rigid thermoplastic resin having a cellular core and an integral solid skin,along the longitudinally extending surfaces of the slats, the slat having a density of 0.4 to 0.6 g/cc. Advantageously, the upper and lower surfaces of the slat have a radius of curvature less than the width of the slat and, preferably, the upper and lower surfaces have substantially the same radius of curvature.

BRIEF DESCRIPTION OF THE DRAWINGS

FIG. 1 is a fragmentary front view of venetian blind in a raised condition;

FIG. 2 is an end elevational view of a venetian blind slat constructed in accordance with the present invention;

FIG. 3 is a fragmentary end elevational view of a venetian blind incorporating the slat of the present invention;

FIG. 4 is an end elevational view illustrating a stack of venetian blind slats constructed in accordance with the present invention;

FIG. 5 is a fragmentary plan view of a venetian blind slat; and

FIG. 6 is a fragmentary end elevational view of a modified form of venetian blind slat.

FIG. 1 illustrates a venetian blind in a raised or open position. In general, the venetian blind includes a headrail 10, a bottom rail 11, and a plurality of slats 12 supported on conventional venetian blind ladders 13 formerly formed of tape or string. As is conventional, the ladders are mounted in the headrail in a manner that enables raising one ladder string while lowering the other to control tilting of the slat when the blind is in an open or at least partially open condition, and the lower ends of the ladders are attached to the bottom rail 11. Lift cords 15 are attached to the bottom rail and extend upwardly through cord openings in the slats and into the headrail, and then lengthwise of the headrail and through a cord lock 16 with operating portions of the lift cords 15 extending downwardly as indicated at 17. As is conventional, the operating portions of the lift cords can be pulled downwardly to raise the bottom rail and move the slats to a raised condition, and the operating cords can be manipulated to release the cord lock and enable lowering of the blind.

It is generally desirable to minimize the weight of venetian blind slats to reduce the overall weight of the blind and thereby facilitate raising and lowering of the blind. Solid plastic materials used in forming plastic venetian blind slats, have relatively high density, generally over three times the density of woods that were used in making wooden blind slats, and to reduce the overall weight of a venetian blind formed with plastic slats, it has been the practice to use relatively thin slats having a thickness in a range between 0.05 to 0.15 cm. However, such thin slats had a relatively low beam strength and it was generally necessary to reduce the spacing between the ladder tapes from about 60 cm as was customary in venetian blinds with wood slats, to about 20 or 30 cm for venetian blinds with plastic slats.

In accordance with the present invention, the venetian blind slat 12 is formed of rigid thermoplastic resin and has a cellular core **12*a* and an integral solid skin 12*b*** that extends along the longitudinally extending surfaces of the slat. The slat with the cellular or foamed core and integral skin is formed so to have a low density of from 0.4 to 0.6 grams per cc, which density is about 0.25 to 0.4 with respect to the corresponding solid thermoplastic resin. The rigid thermoplastic resin is advantageously selected to be of a type that can be foamed during extrusion to form a slat with a cellular core and an integral solid skin and having the desired slat size and configuration. As is well known to those skilled in the art, a blowing agent is mixed with the rigid thermoplastic resin either before or during melting of the resin in the extruder. The resin is heated in the extruder to a temperature above the decomposition temperature of the blowing agent and extruded under high pressure through a die having the desired shape, and the surface of the extrudate is chilled at a location close to the die opening to produce a thin high density skin around the extrudate. Rigid PVC has many desirable characteristics for use in slats including stiffness, stability, resistance to moisture and sunlight and the rigid thermoplastic resin is preferably a rigid vinyl chloride polymer. The rigid thermoplastic resin may, for example, be a polyvinyl chloride extrusion compound marketed by B. F. Goodrich under the trademark "GEON" 87600.

The slat 12 is formed with a longitudinally extending transversely convex upper surface US and in opposed longitudinally extending transversely concave lower surface LS, and opposed longitudinally extending edge surfaces ES. In order to enhance the beam strength of the slat and resistance to bending or sagging, the upper and lower surfaces are formed with a short radius of curvature designated RC in FIG. 2, which is less than the width W of the slat. The radii of curvature CU and CL, of the upper and lower surfaces of the slats is preferably substantially the same so that the lower surface LS of one slat will substantially conform to the upper surface US of the subjacent slat, to minimize the stacking height of the slats when the slats are in a fully raised position as shown in FIG. 4. In the embodiment illustrated, the slat 12 has a width W of about 5 cm (approximately 2 inches) and the radius of curvature is about 4 cm. The slat has a thickness T at the longitudinal center about 0.38 cm and a crown height CH, measured between the crest of the upper surface US and a plane through the lower edges of the lower surface LS, in the range from 1.1 to 1.2 cm. With this configuration, it has been found that the foamed plastic slats have sufficient beam strength so that they can be supported by ladder tapes spaced apart a distance of the order of 60 cm without bending or sagging. As will be seen, configuring the slats with a radius of curvature less than the width of the slats enhances the crown height of the slat and hence the beam strength of the slat, and that using the same short radii of curvature for both the upper and lower surfaces provides a slat having a greater thickness along the longitudinal center line of the slat and such that the slats can stack in close nested relation as shown in FIG. 4.

Cord openings 12*c* are provided in the slats 12 for the lift cords 15. In order to facilitate tight closing of the slats when the ladders 13 are operated to tilt the slats to a closed condition, the cord openings 12*c* are preferably elongated in a direction crosswise of the slat and offset towards the edge of the slat that is at the inner side of the blind, as best shown in FIG. 5.

The venetian blind slat shown in FIG. 6 is formed and configured the same as the slat 12 illustrated and described in connection with FIGS. 1–5, and differs only in the provision of lengthwise extending depressions or grooves 12*d* in the upper surface US inwardly to the edges ES, for decorative purposes. The slat in FIG. 6 is otherwise formed and configured in the same as in FIGS. 1–5 and like numerals are used to designate corresponding parts.

The embodiments of the invention in which an exclusive property or privilege is claimed are defined as follows:

1. An elongate venetian blind slat having a longitudinally extending transversely convex upper surface and an opposed longitudinally extending edge surfaces, the slat consisting of a rigid thermoplastic resin and having a cellular core and in integral solid skin along the longitudinally extending upper and lower surfaces and edge surfaces of the slat, the slat having a density from 0.4 to 0.6 g/cc, the upper and lower surfaces having a radius of curvature less than the width of the slat, the upper and lower surfaces having substantially the same radius of curvature.

2. An elongate venetian blind slat according to claim 1 wherein the convex upper surface of the slat has a crest spaced above a plane through lower edges of the concave lower surface a distance greater than 20% of the width of the slat.

3. An elongate venetian blind slat according to claim 1 wherein the thermoplastic resin is a vinyl chloride polymer.

4. An elongated venetian blind slat having longitudinally extending transversely convex upper surface and an opposed longitudinally extending transversely concave lower surface and opposed longitudinally extending edge surfaces, the slat consisting of a rigid thermoplastic resin and having a cellular core and in integral solid skin along the longitudinally extending upper and lower surfaces and edge surfaces of the slat, the slat having a density of 0.25 to 0.4 with respect to the corresponding solid thermoplastic resin, the upper and lower surfaces having a radius of curvature less than the width of the slat, the upper and lower surfaces having substantially the same radius of curvature.

5. An elongate venetian blind slat according to claim 4 wherein the slat has a density of 0.4 to 0.6 g/cc.

6. An elongate venetian blind slat according to claim 4 wherein the upper convex surface of the slat has a crest spaced above a plane through lower edges of the concave lower surface a distance greater than 20% of the width of the slat.

* * * * *